US008327475B2

(12) United States Patent
Haffner et al.

(10) Patent No.: US 8,327,475 B2
(45) Date of Patent: Dec. 11, 2012

(54) BEDDING FOUNDATION HAVING NESTABLY STACKABLE SPRING ASSEMBLY WELDED TO BORDER WIRE WITH GENERALLY RECTANGULAR CROSS-SECTION

(75) Inventors: David S. Haffner, Carthage, MO (US); John E. Hull, Monett, MO (US); Steven M. Montague, Carthage, MO (US); Darrell A. Richmond, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 13/344,712

(22) Filed: Jan. 6, 2012

(65) Prior Publication Data

US 2012/0110732 A1 May 10, 2012

Related U.S. Application Data

(63) Continuation of application No. 12/821,559, filed on Jun. 23, 2010.

(51) Int. Cl.
*A47C 23/02* (2006.01)

(52) U.S. Cl. ..... 5/260; 5/247; 5/255

(58) Field of Classification Search ..... 5/8, 400–402, 5/200.1, 230, 239, 246, 247, 255, 260, 263; 267/95, 100, 101, 103, 105
See application file for complete search history.

(56) References Cited

U.S. PATENT DOCUMENTS

| | | | | |
|---|---|---|---|---|
| 2,336,975 | A | | 12/1941 | Asaro |
| 2,885,693 | A | | 5/1959 | Wuest |
| RE25,951 | E | | 12/1965 | Nachman, Jr. |
| 3,417,593 | A | | 12/1968 | Lewis |
| 3,737,929 | A | | 6/1973 | Golembeck |
| 3,756,167 | A | * | 9/1973 | Wilson ..... 108/57.14 |
| 3,914,809 | A | | 10/1975 | Ciampa et al. |
| 3,934,446 | A | | 1/1976 | Avitzur |
| 4,106,140 | A | | 8/1978 | Kievits |
| 4,245,363 | A | | 1/1981 | Callaway |
| 4,470,584 | A | * | 9/1984 | Mizelle ..... 267/103 |
| 4,638,995 | A | * | 1/1987 | Wilson ..... 482/142 |
| 4,739,977 | A | | 4/1988 | Dabney |
| 5,052,064 | A | * | 10/1991 | Hagemeister et al. ..... 5/246 |
| 5,361,434 | A | | 11/1994 | Hagemeister et al. |
| 5,497,979 | A | * | 3/1996 | Schulz et al. ..... 267/103 |
| 7,237,282 | B2 | | 7/2007 | Beck et al. |
| 7,398,568 | B1 | | 7/2008 | Clark et al. |
| 7,805,780 | B2 | | 10/2010 | Davis et al. |

* cited by examiner

*Primary Examiner* — Robert G Santos
*Assistant Examiner* — Nicholas Polito
(74) *Attorney, Agent, or Firm* — Wood, Herron & Evans, LLP

(57) ABSTRACT

A bedding foundation having a nestably stackable spring assembly, including a border wire having a generally rectangular cross-section. The foundation's spring assembly may be nestably stacked with numerous other such assemblies for transportation, thereby avoiding the need to compress and tie the assembly for shipping. Each foundation assembly includes a number of corrugated support wires having alternating peaks and valleys. The border wire is generally rectangular in cross-section to reduce wire costs without compromising beam strength of the border wire.

22 Claims, 7 Drawing Sheets

BEDDING FOUNDATION HAVING NESTABLY STACKABLE SPRING ASSEMBLY WELDED TO BORDER WIRE WITH GENERALLY RECTANGULAR CROSS-SECTION

CROSS-REFERENCE TO RELATED APPLICATIONS

This application is a continuation of U.S. patent application Ser. No. 12/821,559 filed Jun. 23, 2010 entitled "Bedding Foundation Having Border Wire With Generally Rectangular Cross-Section", which is fully incorporated herein.

BACKGROUND OF THE INVENTION

This invention relates generally to bedding and, more particularly, to a bedding foundation having a nestably stackable spring assembly.

Bedding foundations, or so-called box springs, generally include a base and an upper grid including a generally rectangular border wire between which coil or bent wire spring modules are located. As thus manufactured, these box spring assemblies are bulky and shipping them to the manufacturer for application of padding and covering thereto is costly because of space requirements. To reduce the space requirements, it is customary to compress the assemblies to reduce their individual thicknesses and to tie them in their compressed state. This involves using presses and ties which are expensive, and the extra operations of pressing and tying the assemblies also adds to their manufacturing cost. At the delivery end, the manufacturer must cut and discard the ties before applying the covering. These additional material and handling expenses increase the end cost of box spring assemblies.

Box spring assemblies by their very nature are intended to provide a stable support foundation for mattresses or other bedding placed on top thereof. Toward that end, the components used in the box spring assemblies should be securely and firmly mounted in the assembly to avoid any wobble or shifting during use.

U.S. Pat. Nos. 5,052,064 and 7,237,282 disclose bedding foundations having nestably stackable spring assemblies which may reduce shipping costs. However, each of the foundations disclosed in these patents has an upper border wire having a round cross-sectional configuration.

The border wire of these and other known bedding foundations is often three-gauge having a diameter of 0.243 inches. To make a border wire having the same beam strength, but made from a smaller diameter wire, say four-gauge wire having a diameter of 0.224 inches, would save material and therefore reduce the end cost of the foundation. In order to achieve the same beam strength, the four-gauge border wire must be changed or shaped from a circular cross-section to a rectangular cross-section in accordance with the present invention. Thus, the present invention enables one to use a four-gauge wire rather than a three-gauge wire in the border wire of the bedding foundation and therefore, reduce wire cost without giving up any beam strength.

In order to achieve cost savings, it would be desirable to reduce the cross-sectional area of the border wire of a bedding foundation (by creating the border wire from a smaller diameter wire) while maintaining the same beam strength or increasing it.

Therefore, a bedding foundation having a nestable, stackable spring assembly, including a border wire with a rectangular cross-section that can be stacked for shipping without having to compress and tie the spring assembly, would be a significant improvement.

SUMMARY OF THE INVENTION

This invention provides the desirable cost savings in wire without compromising the integrity of known bedding foundations. In one embodiment, this invention is a bedding foundation having a nestably stackable spring assembly which may be shipped separately from the bases of the foundations. This bedding foundation comprises a rectangular base and a spring assembly fixedly attached atop the base. Padding overlies the spring assembly and a fabric covering surrounds the spring assembly, padding and base.

The nestable stackable spring assembly includes a rectangular border wire having two parallel sides and two parallel ends. The border wire has a generally rectangular cross-sectional configuration with the height being greater than the width of the cross-section. The spring assembly further comprises a plurality of spaced and longitudinally extending support wires parallel to the border wire sides and extending between the border wire ends and being welded thereto. Each support wire has ends welded to the border wire ends and is a continuous piece of wire. These support wires are generally corrugated along their lengths, having a plurality of flattened peaks and a plurality of flattened valleys. The flattened peaks are generally co-planar with the plane defined by the border wire, and the flattened valleys are displaced beneath and intermediate of the peaks.

The spring assembly further comprises longitudinally spaced, parallel and transversely extending upper connector wires parallel to the border wire ends and welded along their lengths to the peaks of the support wires. In addition, the spring assembly may comprise a plurality of longitudinal wires welded to the upper connector wires and having ends welded to the border wire ends and extending parallel the border wire sides.

The longitudinal voids between the peaks of the support wires are of a greater dimension than the valleys of the support wires. This configuration enables one spring assembly to be nestably stacked atop a second spring assembly since the support wire valleys of the first assembly fit into the voids between the peaks of the support wires of the second assembly. Such a nested and stacked arrangement results in a total height dimension which is less than the sum of the individual assembly height dimensions.

The border wire of the spring assembly of this invention has a unique cross-sectional configuration which enables the border wire to be made of a larger gauge, smaller diameter wire than heretofore known in the art without comprising the beam strength of the border wire when compared to prior art border wires having a round cross-sectional configuration. The smaller diameter wire, when re-shaped from a circular cross-section into a rectangular cross-section, has the same cross-sectional area as when it had a circular cross-section. One advantage of this invention is that it enables a bedding foundation having a wire core to be made using less steel or material, thereby reducing the ultimate cost of the foundation to the foundation's assembler.

In addition to reducing the quantity of wire necessary to manufacture a spring core for use in a bedding foundation, the unique shape of the border wire provides a secure connection between the ends of the support wires and the border wire.

Although one type of wire core has been described, the present border wire may be used in any bedding foundation. For example, individual coil springs may be used rather than generally corrugated support wires, the individual coil springs being clipped to the unique border wire of this invention.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
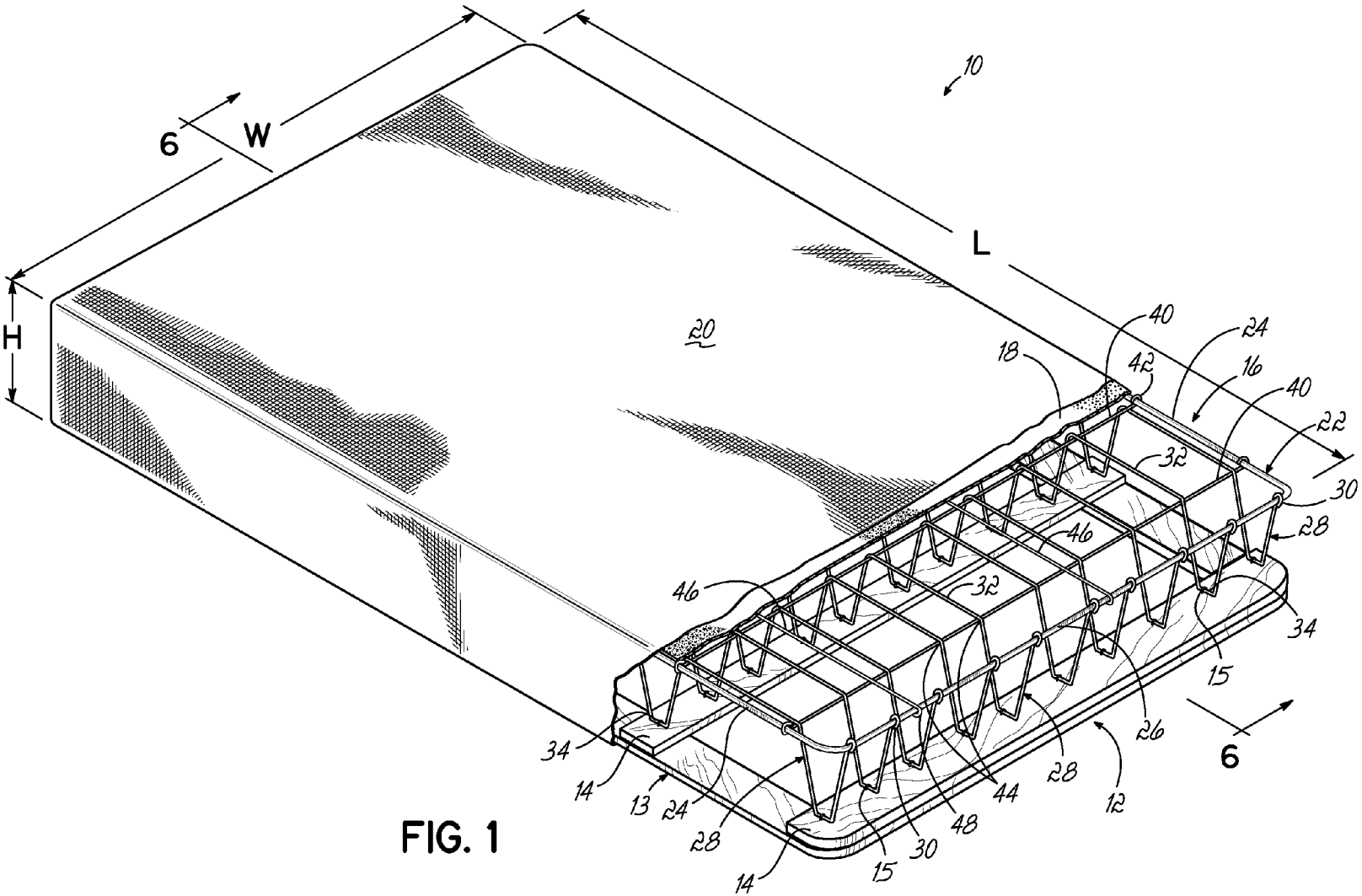
FIG. 1 is a perspective view, partially broken away, of a bedding foundation according to one embodiment of this invention.

Referring first to FIG. 1, a bedding foundation 10, according to one embodiment of this invention, is illustrated. As shown in FIG. 1, the foundation 10 has a longitudinal dimension or length L, a transverse dimension or width W and a height H. Although the length L is shown as being greater than the width W, they may be identical.

Figure 2:
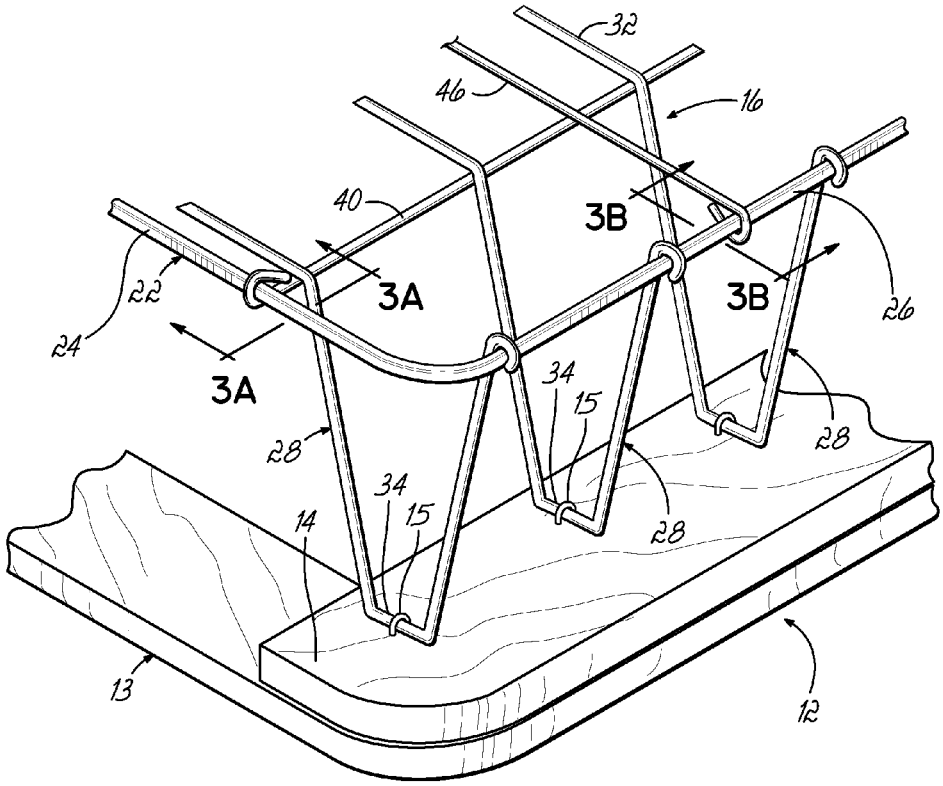
FIG. 2 is an enlarged perspective view illustrating a portion of the foundation of FIG. 1.

The foundation 10 has a base 12, including a rectangular base frame 13 on which transverse wooden slats 14 are attached. A nestably stackable spring assembly or wire core 16 is fixed atop the base 12 and, more particularly, secured to the transverse slats 14 of base 12 with staples 15, as shown in FIG. 2. Padding 18 overlies the nestably stackable spring assembly 16, and a fabric covering 20 overlies the padding 18 and surrounds the nestably stackable spring assembly 16 and the base 12. Although the base 12 is usually made of wood, it may be made of any other material, such as plastic, for example.

The nestably stackable spring assembly 16 includes a rectangular steel border wire 22 having two parallel sides 24, 24 and two parallel ends 26, 26. The parallel sides 24, 24 are longer than the parallel ends 26, 26 in the embodiment illustrated.

Figure 6:
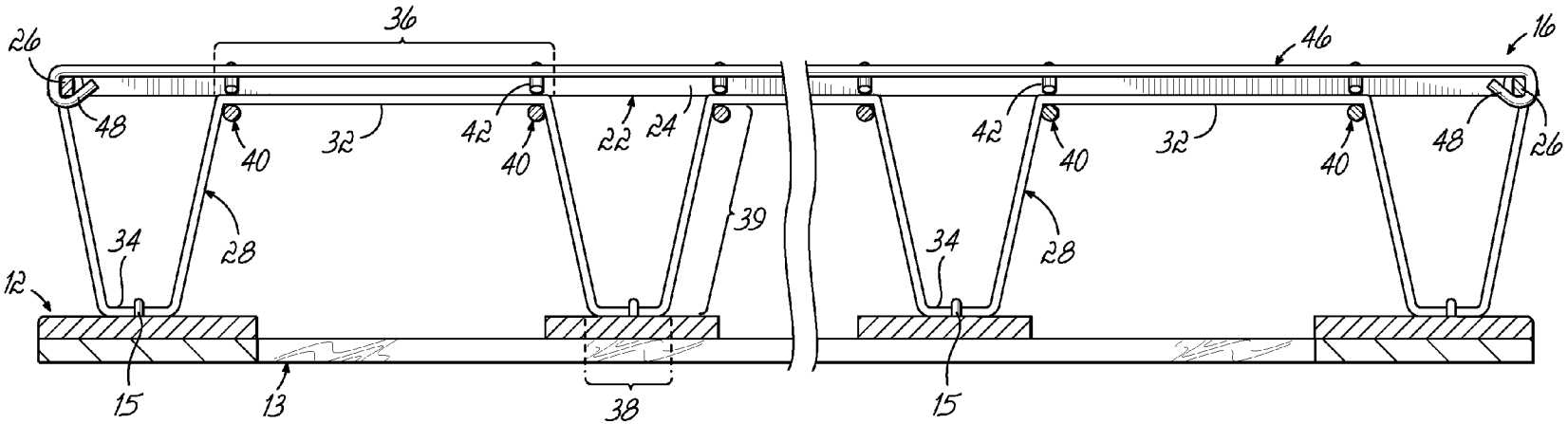
FIG. 6 is a cross-sectional view taken along the line 6-6 of FIG. 1 without padding or a fabric covering.

Transversely spaced, parallel, and longitudinally extending steel support wires 28 are parallel to the border wire sides 24, 24 and have ends 30 which are welded to and/or crimped around the ends 26, 26 of the border wire 22. These support wires 28 are formed so as to be generally corrugatedly-shaped along their lengths, having peaks 32 and valleys 34. These peaks 32 and valleys 34 are flattened at their respective distal portions 36 and 38, respectively. See FIG. 6. The adjacent distal portions 36, 38 are joined together by linear connecting portions 39 of the support wire 28. Alternatively, the support wires may be resilient with non-linear arms or connecting portions joining adjacent flattened peaks and flattened valleys. Examples of such support wires are disclosed in U.S. patent application Ser. No. 12/352,208, which is fully incorporated herein.

Longitudinally spaced, parallel and transversely extending steel upper connector wires 40 extend parallel to the border wire ends 26, 26 and have ends 42 which are welded to and/or crimped around the border wire sides 24, 24. These upper connector wires 40 are welded intermediate of their ends 42, 42 along their lengths at intersections 44 to the flattened peaks 32 of the support wires 28.

The support wires 28 have flattened distal peak portions 36 and flattened distal valley portions 38, with the support wire ends 30 being welded to and/or crimped around the border wire 22. In this embodiment, two upper connector wires 40 per flattened distal peak portion 36 are illustrated. However, any number of upper connector wires 40 may be secured, i.e., welded to each flattened distal peak portion 36 of each support wire 28. The distal valley portions 38 of the support wires 28 may be stapled or otherwise attached to the transverse slats 14 which are, in turn, affixed to the base frame 13.

If desired, additional steel end wires (not shown) may be added either before or after the stackable spring assembly 16 has reached its final assembly destination. These end wires have spaced ends which are crimped around the border wire 22 and the endmost upper connector wire 40, respectively. These end wires provide additional stiffness to the stackable assembly 16 in an edgemost location of the ends of the assembly 16 so as to prevent the end border wires from deflecting and being permanently distorted when a person sits on the end of a bed of which the foundation forms a part. Such steel end wires are shown in U.S. Pat. No. 5,361,434, which is hereby incorporated by reference in its entirety.

Referring again to FIG. 1, continuous longitudinal wires 46 may be included in the stackable spring assembly 16. These longitudinal wires 46 have their ends 48 welded to and/or crimped around the border wire ends 26, 26. These longitudinal wires 46 may be welded along their lengths to the upper connector wires 40 as desired. In the illustrated embodiment, two longitudinal wires 46 per foundation 10 are illustrated. However, any number of longitudinal wires 46 may be incorporated into the foundation.

The nestably stackable spring assembly 16 of bedding foundation 10 is generally manufactured by a supplier, who then ships it to an assembler. The assembler adds to the spring assembly 16 the wooden base 12, incorporates padding 18, and covers the components with upholstery 20 to make a completed product.

Figure 7:
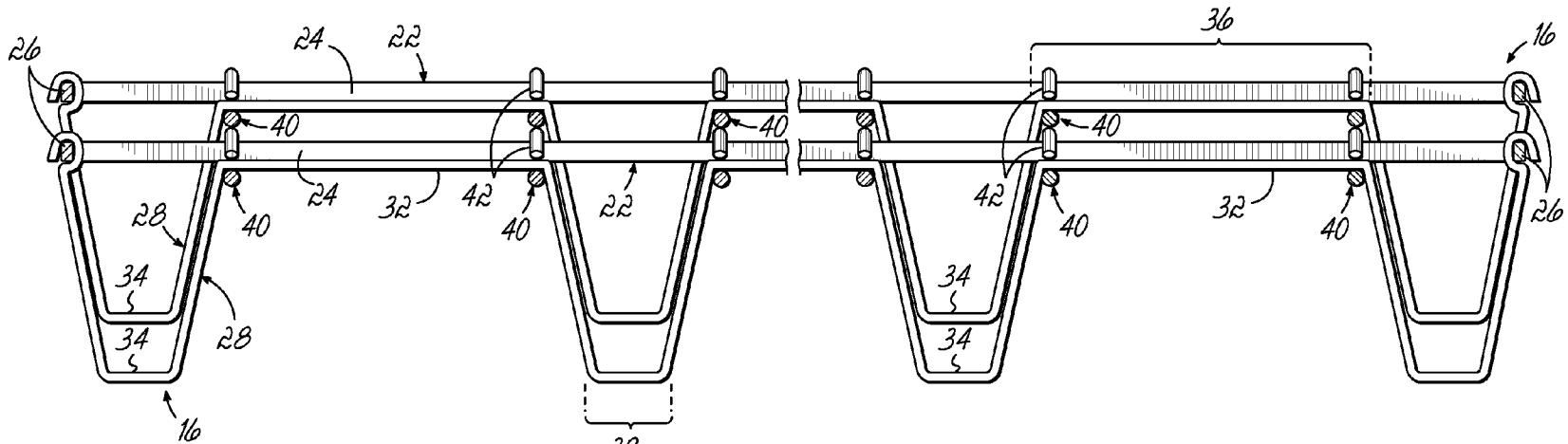
FIG. 7 is a side elevational view of two stacked spring assemblies of the foundation of FIG. 1 without padding or a fabric covering.

This invention facilitates shipment of the metal core or stackable assembly 16 by a supplier to the assembler. With reference to FIG. 7, a first stackable spring assembly 16 may be placed upon a surface with the flattened distal valley portions 38 of the support wires 28 oriented downwardly and the flattened distal peak portions 36 of the support wires 28 oriented upwardly. Next, a second like assembly 16 is placed atop the first assembly 16, with its flattened distal valley portions 38 and flattened distal peak portions 36 likewise oriented downwardly and upwardly, respectively. The flattened distal valley portions 38 of the second assembly 16 are thereby allowed to enter into the voids between the flattened distal peak portions 36 of the first assembly 16. The second assembly 16 nestles downwardly within the first assembly 16 until the outside dimension of the connecting portions 39 of the valleys 34 of the second assembly 16 is equal to the inside dimension of the connecting portions 39 of the valleys 34 of the first assembly 16. At this point, the second assembly 16 comes to nest within the first assembly 16, with the overall height of the nested assemblies 16, 16 substantially less than the sum of the individual heights of the assemblies 16, 16. Of course, any number of assemblies 16 may be nested and stacked together for storage or shipment.

One advantage of the spring assembly 16 and associated bedding foundation 10, according to this invention, is that the border wire 22 is uniquely configured to enable the border wire 22 to be made of a lesser gauge, smaller diameter wire than existing border wires without giving up any strength. In the embodiment of the bedding foundation 10 and associated spring assembly 16 shown in the drawings, the border wire 22 has a rectangular cross-sectional configuration with the height $H_2$ of border wire 22 being greater than the width $W_2$ of the border wire 22. See FIG. 5.

Figure 4:
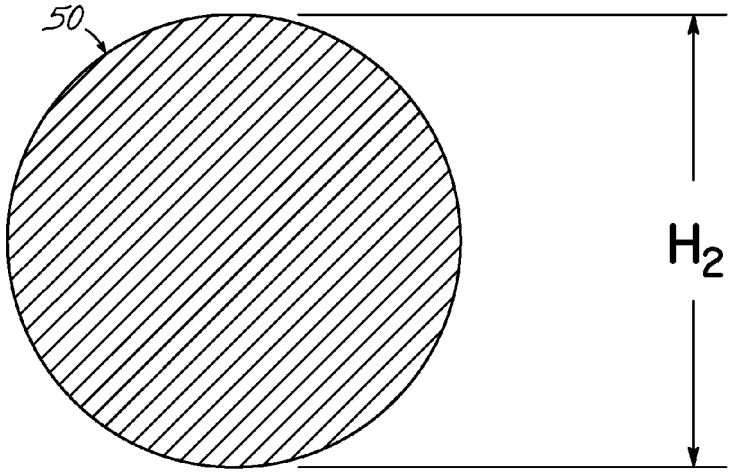
FIG. 4 PRIOR ART
FIG. 4 is a cross-sectional view illustrating prior art.

FIG. 4 illustrates a cross-section of a prior art border wire 50 made of three-gauge wire. The cross-section is round and has a diameter of $H_2$ (0.243 inches in the case of three-gauge wire).

Figure 5:
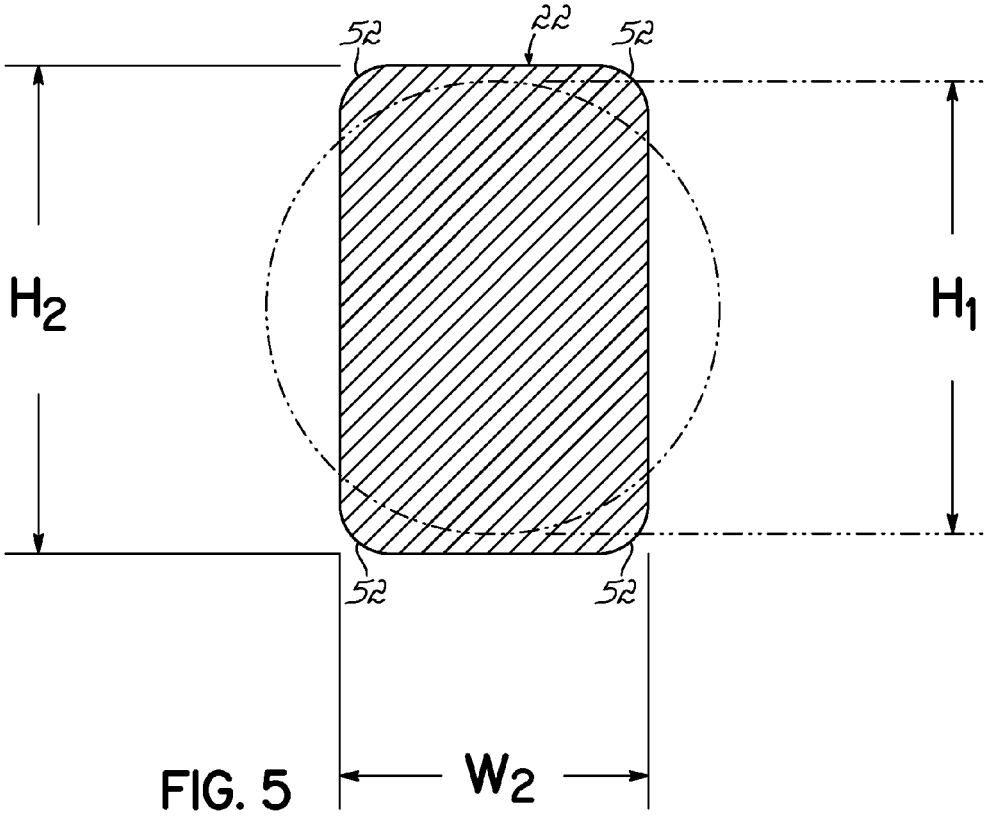
FIG. 5 is a cross-sectional view illustrating the border wire of the present invention.

FIG. 5 illustrates a rectangular cross-section of the border wire 22 of foundation 10. The border wire 22 is re-shaped into a rectangular cross-section from a four-gauge wire having a round cross-section (shown in dashed lines in FIG. 5) having a diameter of $H_1$, which is less than the diameter $H_2$ of the three-gauge wire shown in FIG. 4. In the example, $H_1$ is 0.224 inches and $H_2$ is 0.243 inches. The cross-section of border wire 22 shown in FIG. 5 is rectangular and has a height of $H_2$ (0.243 inches, same as the diameter of the three-gauge wire shown in FIG. 4) and a width of 0.153 inches. Thus, in switching from a three-gauge wire having a round cross-section to a four-gauge wire having a rectangular cross-section, no height is lost. In changing the shape of the border wire 22 from a round cross-section to a rectangular cross-section, the cross-sectional area remains approximately identical. The generally rectangular cross-section of border wire has rounded corners 52 as shown in FIG. 5.

Figure 3A:
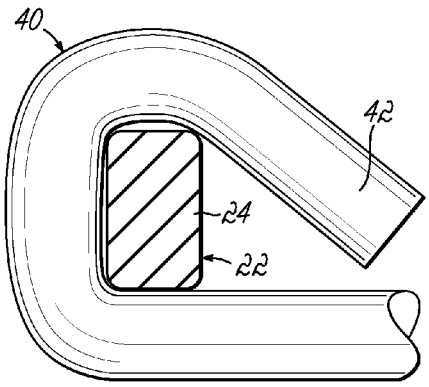
FIG. 3A is a cross-sectional view taken along the line 3A-3A of FIG. 2.
Figure 3B:
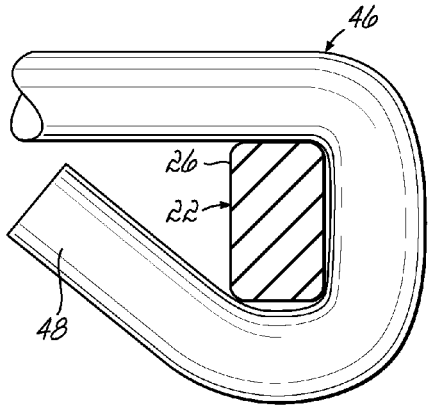
FIG. 3B is a cross-sectional view taken along the line 3B-3B of FIG. 2.

FIG. 3A shows one of the upper connector wires 40 passing underneath one of the sides 24 of border wire 22 and having its end 42 wrapped over and around the border wire 22. FIG. 3B shows one of the longitudinal wires 46 passing over one of the ends 26 of border wire 22 and having its end 48 wrapped under and around border wire 22.

Figure 8:
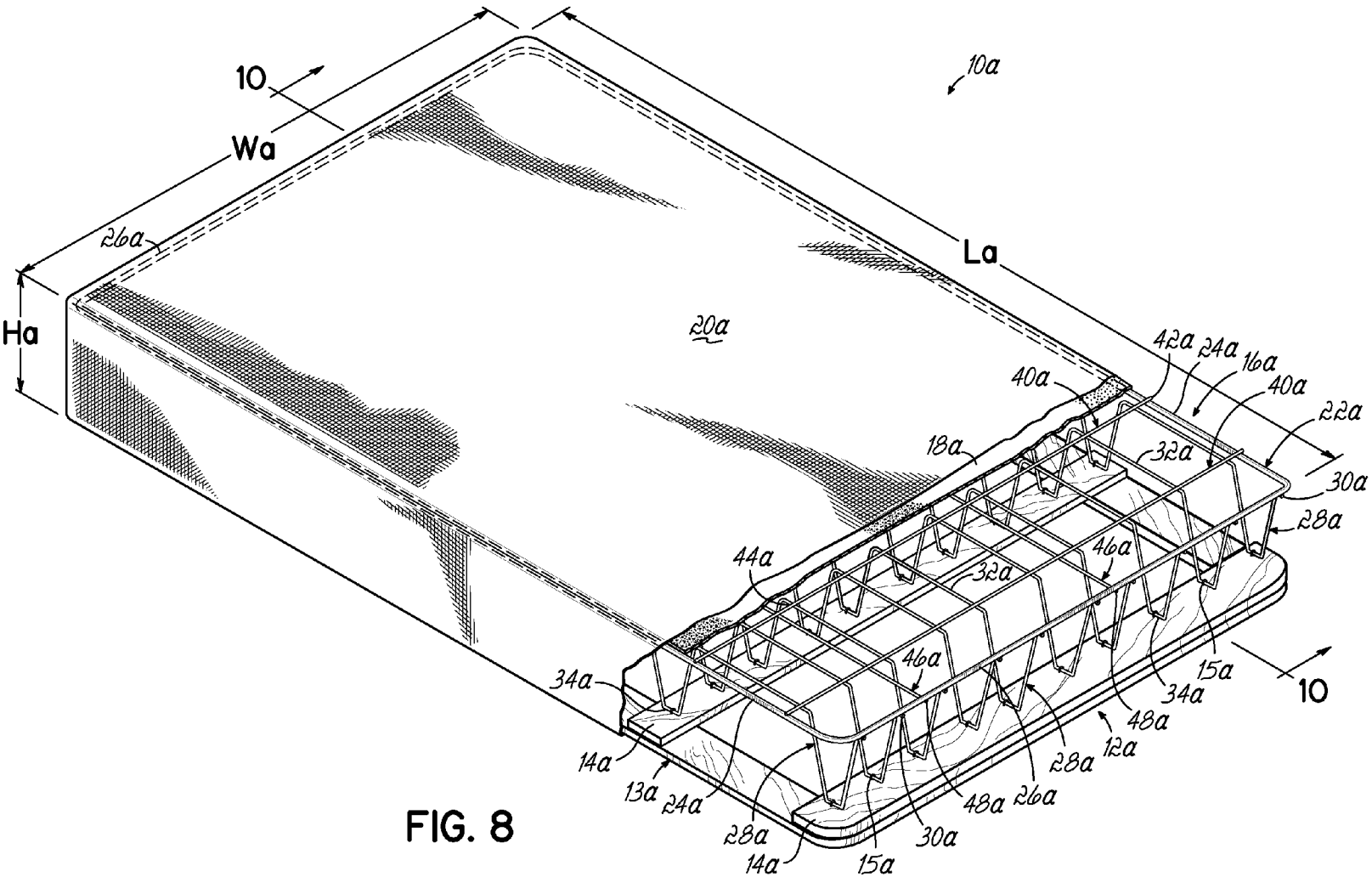
FIG. 8 is a perspective view, partially broken away, of a bedding foundation according to another embodiment.

FIGS. 8-11 illustrate an alternative embodiment of bedding foundation 10*a*. As shown in FIG. 8, the foundation 10*a* has a longitudinal dimension or length La, a transverse dimension or width Wa and a height Ha. Although the length La is shown as being greater than the width Wa, they may be identical.

Figure 9:
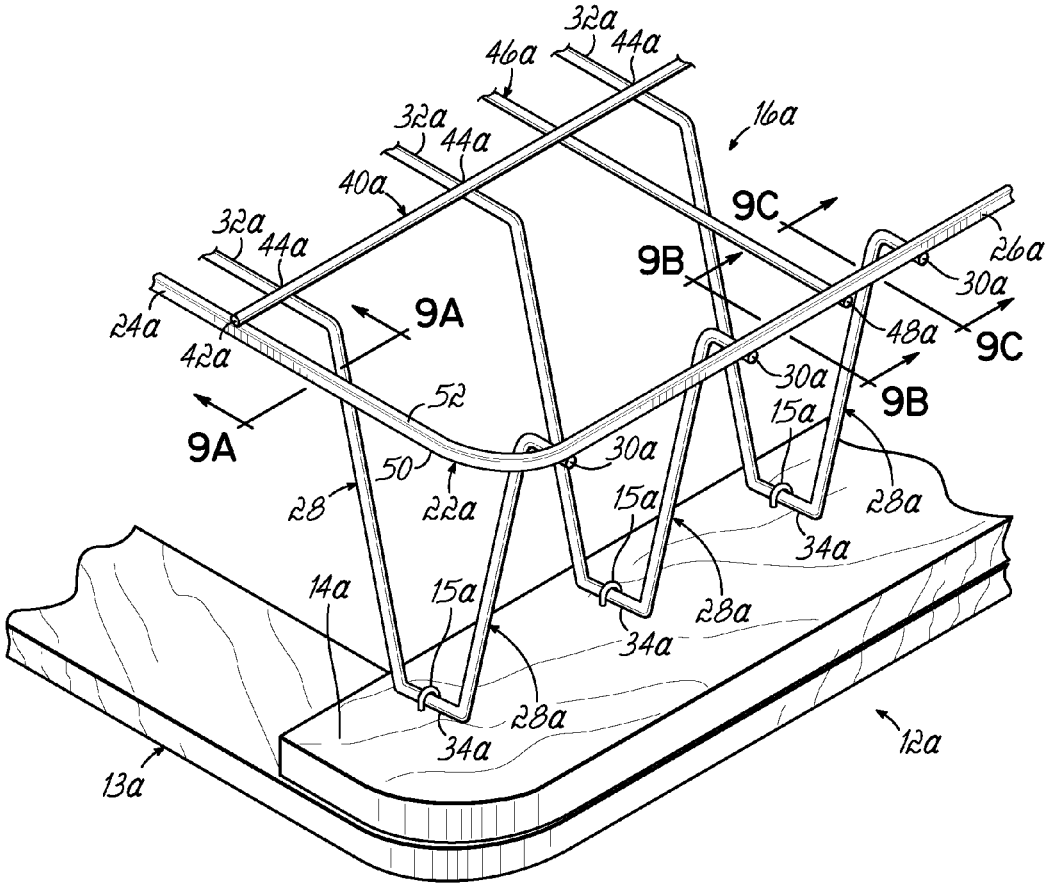
FIG. 9 is an enlarged perspective view illustrating a portion of the foundation of FIG. 8.

The foundation 10*a* has a base 12*a*, including a rectangular base frame 13*a* on which transverse wooden slats 14*a* are attached. A nestably stackable spring assembly or wire core 16*a* is fixed atop the base 12*a* and, more particularly, secured to the transverse slats 14*a* of base 12*a* with staples 15*a*, as shown in FIG. 9. Padding 18*a* overlies the nestably stackable spring assembly 16*a*, and a fabric covering 20*a* overlies the padding 18*a* and surrounds the nestably stackable spring assembly 16*a* and the base 12*a*. Although the base 12*a* is usually made of wood, it may be made of any other material, such as plastic, for example.

The nestably stackable spring assembly 16*a* includes a rectangular steel border wire 22*a* having two parallel sides 24*a*, 24*a* and two parallel ends 26*a*, 26*a*. The parallel sides 24*a*, 24*a* are longer than the parallel ends 26*a*, 26*a* in the embodiment illustrated.

Transversely spaced, parallel, and longitudinally extending steel support wires 28*a* are parallel to the border wire sides 24*a*, 24*a* and have end portions 30*a* which are welded to the ends 26*a*, 26*a* of the border wire 22*a*. These support wires 28*a* are formed so as to be generally corrugatedly-shaped along their lengths, having flattened peaks 32*a* and flattened valleys 34*a*. These peaks 32*a* and valleys 34*a* have different lengths 36*a* and 38*a*, respectively. See FIG. 10. The lengths 36*a*, 38*a* are joined together by linear connecting portions 39*a* of the support wire 28*a*. Alternatively, the support wires may be resilient with non-linear arms or connecting portions joining adjacent flattened peaks and flattened valleys. Examples of such support wires are disclosed in U.S. Pat. Nos. 7,805,780 and 7,930,777, each of which is fully incorporated herein.

As best shown in FIG. 9, an end portion of each of the support wires 28*a* is welded to a lower surface 50 of the border wire 22*a* and, more specifically, to the lower surface 50 of one of the ends 26*a*, 26*a* of the border wire 22*a*.

Longitudinally spaced, parallel and transversely extending steel upper connector wires 40*a* extend parallel to the border wire ends 26*a*, 26*a* and have ends 42*a* which are welded to the border wire sides 24*a*, 24*a*. These upper connector wires 40*a* are welded intermediate of their ends 42*a*, 42*a* along their lengths at intersections 44*a* to the flattened peaks 32*a* of the support wires 28*a*.

Figure 9A:
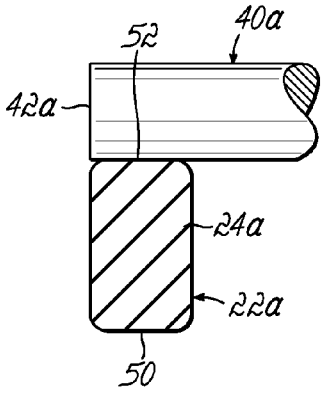
FIG. 9A is a cross-sectional view taken along the line 9A-9A of FIG. 9.

As best shown in FIG. 9A, an end portion 42*a* of each of the upper connector wires 40*a* is welded to a top surface 52 of the border wire 22*a* and, more specifically, to the top or upper surface 52 of one of the sides 24*a*, 24*a* of border wire 22*a*.

The support wires 28*a* have flattened peaks 36*a* and flattened valleys 38*a*, with the support wire end portions 30*a* being welded to the border wire 22*a*. As best shown in FIG. 9C, an end portion 30*a* of each of the support wires 28*a* is welded to lower surface 50 of the border wire 22*a* and, more specifically, to the bottom or lower surface 50 of one of the ends 26*a*, 26*a* of border wire 22*a*.

In this embodiment, two upper connector wires 40*a* per flattened peak 36*a* are illustrated. However, any number of upper connector wires 40*a* may be secured, i.e., welded to each flattened peak 36*a* of each support wire 28*a*. The flattened valleys 38*a* of the support wires 28*a* may be stapled using staples 15*a* or otherwise attached to the transverse slats 14*a* which are, in turn, affixed to the base frame 13*a*.

If desired, additional steel end wires (not shown) may be added either before or after the stackable spring assembly 16*a* has reached its final assembly destination. These end wires have spaced ends which are secured to the border wire 22*a* and the endmost upper connector wire 40*a*, respectively. These end wires provide additional stiffness to the stackable assembly 16*a* in an edgemost location of the ends of the assembly 16*a* so as to prevent the end border wires from deflecting and being permanently distorted when a person sits on the end of a bed of which the foundation forms a part. Such steel end wires are shown in U.S. Pat. No. 5,361,434, which is hereby incorporated by reference in its entirety.

Referring again to FIG. 8, continuous longitudinal wires 46*a* may be included in the stackable spring assembly 16*a*. These longitudinal wires 46*a* have their ends 48*a* welded to the border wire ends 26*a*, 26*a*. These longitudinal wires 46*a* may be welded along their lengths to the upper connector wires 40*a* as desired. In the illustrated embodiment, two longitudinal wires 46*a* per foundation 10*a* are illustrated. However, any number of longitudinal wires 46*a* may be incorporated into the foundation.

Figure 9B:
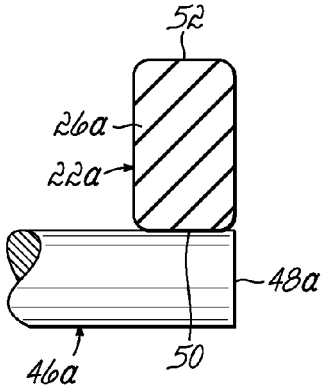
FIG. 9B is a cross-sectional view taken along the line 9B-9B of FIG. 9.
Figure 9C:
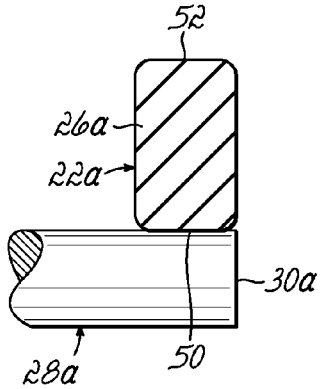
FIG. 9C is a cross-sectional view taken along the line 9C-9C of FIG. 9.
Figure 10:
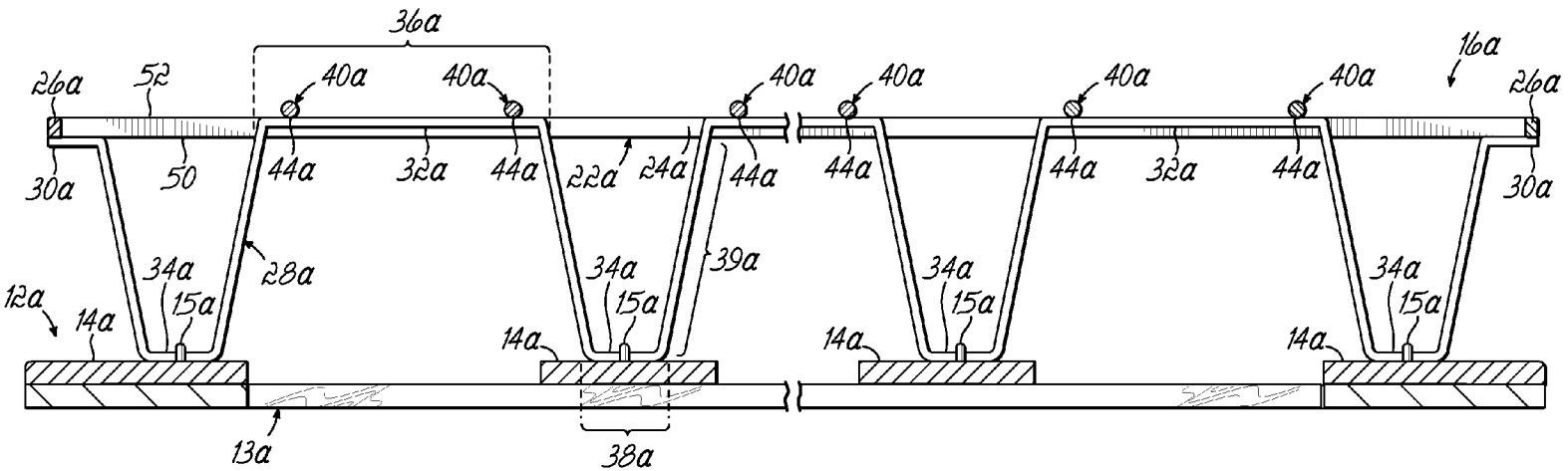
FIG. 10 is a cross-sectional view taken along the line 10-10 of FIG. 8.

As best shown in FIG. 9B, an end portion of each of the continuous longitudinal wires 46*a* is welded to lower surface 50 of the border wire 22*a* and, more specifically, to the bottom or lower surface 50 of one of the ends 26*a*, 26*a* of border wire 22*a*.

The nestably stackable spring assembly 16*a* of bedding foundation 10*a* is generally manufactured by a supplier, who then ships it to an assembler. The assembler adds to the spring assembly 16*a* the wooden base 12*a*, incorporates padding 18*a*, and covers the components with upholstery 20*a* to make a completed product.

Figure 11:
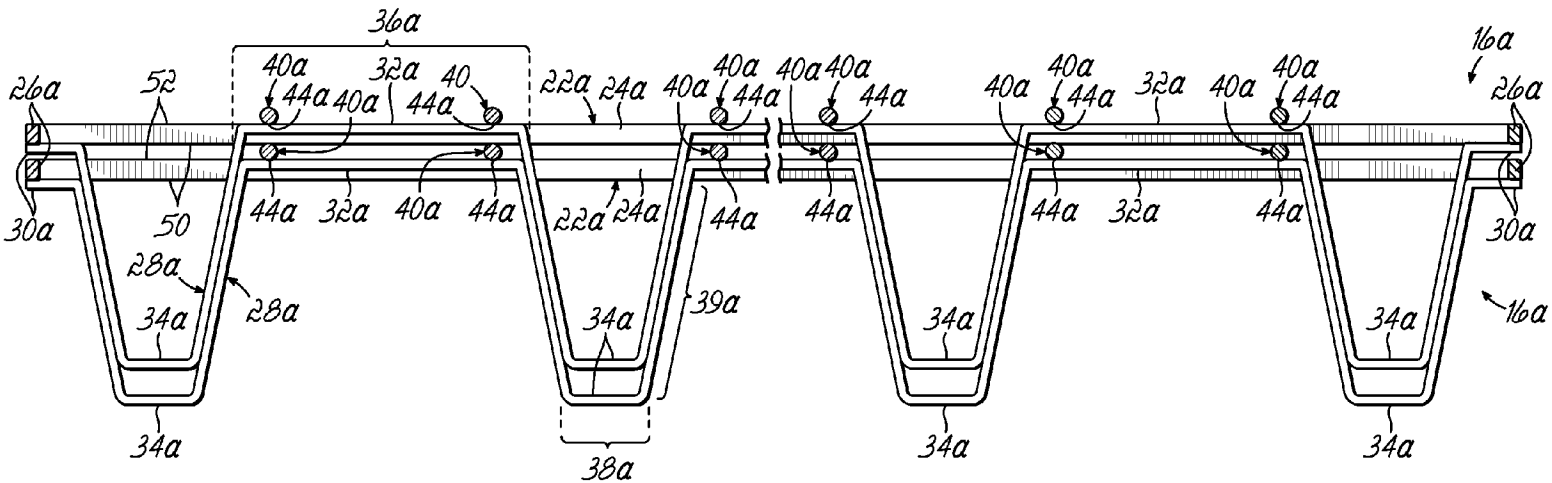
FIG. 11 is a side elevational view of two stacked spring assemblies of the foundation of FIG. 8 without padding or a fabric covering.

This invention facilitates shipment of the metal core or stackable assembly 16*a* by a supplier to the assembler. With reference to FIG. 11, a first stackable spring assembly 16*a* may be placed upon a surface with the flattened valleys 38*a* of the support wires 28*a* oriented downwardly and the flattened peaks 36*a* of the support wires 28*a* oriented upwardly. Next, a second like assembly 16*a* is placed atop the first assembly 16*a*, with its flattened valleys 38*a* and flattened peaks 36*a* likewise oriented downwardly and upwardly, respectively. The flattened valleys 38*a* of the second assembly 16*a* are thereby allowed to enter into the voids between the flattened peaks 36*a* of the first assembly 16*a*. The second assembly 16*a* nestles downwardly within the first assembly 16*a* until the outside dimension of the connecting portions 39*a* of the valleys 34*a* of the second assembly 16*a* is equal to the inside dimension of the connecting portions 39*a* of the valleys 34*a* of the first assembly 16*a*. At this point, the second assembly 16*a* comes to nest within the first assembly 16*a*, with the overall height of the nested assemblies 16*a*, 16*a* substantially less than the sum of the individual heights of the assemblies 16*a*, 16*a*. Of course, any number of assemblies 16*a* may be nested and stacked together for storage or shipment.

One advantage of the spring assembly 16*a* and associated bedding foundation 10*a*, according to this invention, is that the border wire 22*a* is uniquely configured to enable the border wire 22*a* to be made of a lesser gauge, smaller diameter wire than existing border wires without giving up any strength. In the embodiment of the bedding foundation 10*a* and associated spring assembly 16*a* shown in the drawings, the border wire 22*a*, like border wire 22, has a rectangular cross-sectional configuration with the height $H_2$ of border wire 22*a* being greater than the width $W_2$ of the border wire 22*a*. Border wire 22*a* of the embodiment shown in FIGS. 8-11 is identical to border wire 22 and has the same characteristics and advantages described herein.

One of ordinary skill in the art will readily recognize that the alternative embodiments of the foundations shown herein are exemplary only of a wide variety of alternative configurations that are readily possible within the scope of this invention.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A bedding foundation comprising:

a rectangular base;

a spring assembly fixedly attached atop the base;

padding overlying the spring assembly;

a fabric covering surrounding the spring assembly, padding and base;

the spring assembly comprising, a generally rectangular border wire having two parallel sides and two parallel ends; and a plurality of spaced and longitudinally extending support wires parallel the border wire sides, each of said support wires extending between the border wire ends and being welded thereto, each support wire being a continuous piece of wire having a plurality of flattened peaks and a plurality of flattened valleys, the flattened peaks being generally co-planar with the border wire and the flattened valleys being vertically displaced beneath and intermediate of the flattened peaks;

wherein the border wire has a generally rectangular cross-sectional configuration and is re-shaped from a smaller diameter wire than a border wire having a circular cross-section having approximately the same beam strength, thereby enabling the nestably stackable wire core assembly to be made using less material.

2. The bedding foundation of claim 1 further comprising:

a plurality of longitudinally spaced, parallel and transversely extending upper connector wires parallel to the border wire ends and having ends welded to the border wire sides, the upper connector wires being connected intermediate of their ends along their lengths thereof to the flattened peaks of the support wires.

3. The bedding foundation of claim 1 wherein longitudinal voids between flattened peaks are of a dimension greater than the flattened valleys.

4. The bedding foundation of claim 1 wherein the border wire has a cross-section having a height and a width, the height being greater than the width.

5. The bedding foundation of claim 1 wherein the border wire is made of four-gauge wire.

6. The bedding foundation of claim 1 wherein the cross-section of the border wire has rounded corners.

7. The bedding foundation of claim 1 wherein border wire sides are longer than the border wire ends.

8. The bedding foundation of claim 1 wherein the ends of the support wires are welded to the border wire ends.

9. The bedding foundation of claim 8 wherein the ends of the support wires are welded a lower surface of the border wire ends.

10. The bedding foundation of claim 1 wherein the support wires are generally parallel with each other.

11. A bedding foundation comprising:

a rectangular base comprising a rectangular base frame and a plurality of transverse slats;

a spring assembly fixedly attached atop the base;

the spring assembly comprising:

a generally rectangular border wire having two parallel sides and two parallel ends; and a plurality of spaced and longitudinally extending support wires extending between the border wire ends, each support wire having a plurality of flattened peaks and a plurality of flattened valleys, the flattened peaks being generally co-planar with the border wire and flattened valleys being vertically displaced beneath and intermediate of the flattened peaks;

wherein the border wire has a generally rectangular cross-sectional configuration to provide a secure connection between the ends of the support wires and the border wire and is re-shaped from a smaller diameter wire than a border wire having a circular cross-section having approximately the same beam strength, thereby enabling the nestably stackable wire core assembly to be made using less material.

12. The bedding foundation of claim 11 further comprising:

a plurality of longitudinally spaced, parallel and transversely extending upper connector wires parallel to the border wire ends and having ends welded to the border wire sides, the upper connector wires being welded intermediate of their ends along their lengths thereof to the flattened peaks of the support wires.

13. The bedding foundation of claim 11 wherein longitudinal voids between the flattened peaks are of a dimension greater than the flattened valleys.

14. The bedding foundation of claim 11 wherein the border wire has a cross-section having a height and a width, the height being greater than the width.

15. The bedding foundation of claim 11 wherein the border wire is made of four-gauge wire.

16. The bedding foundation of claim 11 wherein the cross-section of the border wire has rounded corners.

17. The bedding foundation of claim 11 wherein border wire sides are longer than the border wire ends.

18. A spring assembly for use in a bedding foundation comprising:

a generally rectangular border wire having two parallel sides and two parallel ends; and a plurality of spaced and longitudinally extending support wires extending between the border wire ends, each support wire having a plurality of flattened peaks and a plurality of flattened valleys, the flattened peaks being generally co-planar with the border wire and flattened valleys being vertically displaced beneath and intermediate of the flattened peaks;

wherein the border wire has a generally rectangular cross-sectional configuration to provide a secure connection between the ends of the support wires and the border wire and is re-shaped from a smaller diameter wire than a border wire having a circular cross-section having approximately the same beam strength, thereby enabling the nestably stackable wire core assembly to be made using less material.

19. The spring assembly of claim 18 further comprising:

a plurality of longitudinally spaced, parallel and transversely extending upper connector wires parallel to the border wire ends and having ends welded to the border wire sides, the upper connector wires being welded intermediate of their ends along their lengths thereof to the flattened peaks of the support wires.

20. The spring assembly of claim 18 wherein longitudinal voids between the flattened peaks are of a dimension greater than the flattened valleys.

21. The spring assembly of claim 18 being a first assembly, which, when placed atop a second assembly of like construction, is nestedly stacked thereon when the flattened valleys of the first assembly enter into the voids between the flattened peaks of the second assembly, the nested assemblies having a total height dimension less than a sum of a height dimension of the first assembly plus a height dimension of the second assembly.

22. The spring assembly of claim 19 wherein border wire sides are longer than the border wire ends.

* * * * *

UNITED STATES PATENT AND TRADEMARK OFFICE

CERTIFICATE OF CORRECTION

PATENT NO. : 8,327,475 B2
APPLICATION NO. : 13/344712
DATED : December 11, 2012
INVENTOR(S) : David S. Haffner et al.

It is certified that error appears in the above-identified patent and that said Letters Patent is hereby corrected as shown below:

Column 1

Line 31, “also adds” should be --also add--.

Column 2

Line 51, “comprising” should be --compromising--.

Column 8

Line 45, “welded a lower” should be --welded to a lower--.

Signed and Sealed this
Nineteenth Day of February, 2013

Teresa Stanek Rea
*Acting Director of the United States Patent and Trademark Office*